US009206662B2

(12) United States Patent
Liu et al.

(10) Patent No.: US 9,206,662 B2
(45) Date of Patent: Dec. 8, 2015

(54) UNDERGROUND ANNULAR BLOWOUT PREVENTER AND ASSEMBLY PROCESS THEREOF

(75) Inventors: Qingyou Liu, Chengdu (CN); Wei Li, Chengdu (CN)

(73) Assignee: SOUTHWEST PETROLEUM UNIVERSITY, Chengdu, Sichuan (CN)

( * ) Notice: Subject to any disclaimer, the term of this patent is extended or adjusted under 35 U.S.C. 154(b) by 372 days.

(21) Appl. No.: 13/818,092

(22) PCT Filed: Feb. 21, 2012

(86) PCT No.: PCT/CN2012/071417

§ 371 (c)(1), (2), (4) Date: Feb. 20, 2013

(87) PCT Pub. No.: WO2012/159466

PCT Pub. Date: Nov. 29, 2012

(65) Prior Publication Data

US 2013/0153796 A1 Jun. 20, 2013

(30) Foreign Application Priority Data

May 26, 2011 (CN) ..... 2011 1 0138301

(51) Int. Cl.

| | |
|---|---|
| ***E21B 33/10*** | (2006.01) |
| ***E21B 33/06*** | (2006.01) |
| ***E21B 34/10*** | (2006.01) |
| ***E21B 21/10*** | (2006.01) |

(52) U.S. Cl.

CPC ..... *E21B 33/06* (2013.01); *E21B 21/10* (2013.01); *E21B 33/10* (2013.01); *E21B 34/10* (2013.01); *Y10T 29/49412* (2015.01)

(58) Field of Classification Search

CPC ..... E21B 33/06; E21B 33/10; E21B 34/08

See application file for complete search history.

(56) References Cited

U.S. PATENT DOCUMENTS

| | | | | |
|---|---|---|---|---|
| 3,744,562 | A * | 7/1973 | Priebe et al. | 166/363 |
| 4,574,881 | A * | 3/1986 | Bednarz | 166/75.11 |
| 2011/0297394 | A1* | 12/2011 | VanDelden | 166/373 |

* cited by examiner

*Primary Examiner* — William P Neuder

(74) *Attorney, Agent, or Firm* — Raymond Y. Chan; David and Raymond Patent Firm

(57) ABSTRACT

An underground annular blowout preventer, which belongs to the technical field of underground blowout prevention, includes an upper joint and a lower joint are sleeved outside a central barrel. The lower end of the central barrel is fixedly connected with the lower joint. The lower end of the upper joint is sleeved on the inner side of the upper end of the lower joint. The upper joint is matched with the lower joint through a spline. The lower end of the upper joint can freely move relative to the lower joint along a spline pair. At least one rubber barrel is sleeved on the outer side of the upper joint. The rubber barrel can be extruded and expanded by the upper joint and the lower joint. The underground annular blowout preventer of the present invention can transmit large torque, has a simple structure, long service life, is convenient to use, and can be repeatedly used. The underground annular blowout preventer is used in coordination with a check valve of a near drill in the well drilling process, so that quick sealing of a well can be ensured, and well blowout accidents can be effectively prevented. A pipe column is lowered to seal the well and is lifted to open the well, and the inside of the drill rod is in communication with an annular space after the well is sealed, which facilitates replacement for heavy mud lubrication operations.

8 Claims, 6 Drawing Sheets

A–A

B–B

UNDERGROUND ANNULAR BLOWOUT PREVENTER AND ASSEMBLY PROCESS THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention claims an underground annular blowout preventer, which belongs to the technical field of underground blowout prevention.

2. Description of Related Arts

In the task of oil exploration and oilfield development, well drilling is very important. Looking for and proving oil and gas bearing structures, obtaining industrial oil output, verifying oil and gas bearing areas and reserves of the proved oil and gas bearing structures, obtaining geological data and development data related to the oil field, and extracting the crude oil from underground are all completed through well drilling. Well drilling is a very important part in exploring and exploiting oil and gas resources and an important method of exploring and exploiting oil.

During the well drilling process, when there is oil-gas reservoir, if the bottom-hole pressure is lower than the formation pressure, the formation fluid will enter the well. If a large amount of formation fluid enters the well, well kick, blowout, or even fire may result and cause a major accident. Therefore, it is important to take effective measures to control the pressure in the oil-gas well during well drilling process. However, it is very hard to predict the pressure of the high-pressure oil and gas layer, especially when drilling in the new blocks. As a result, high pressure oil and gas from the stratum may accidentally enter the well during well drilling process. In addition, well kick and blowout accidents occur in the following three states: during the drilling process, lifting and lowering the drill pipe, and emptying the well. The probability of well kick in an empty well is very low, and the probability of well kick or blowout during process of lifting and lowering the drill pipe can be effectively reduced by controlling the velocity of lifting and lowering the drill pipe to avoid overly large suction forces. Because it is impossible to predict the pressure of a high pressure oil and gas layer during drilling process, the probability of well kick or blowout during this process is the highest.

When sign of well kick or blowout is discovered, rapidly shutting in and killing the well are highly effective operations in reducing blowout accidents. The traditional well shut-in operation is as follows (soft shut-in is usually used in China): after discovering well kick, shutting down the blowout preventer after opening the throttle valve, such that the water hammering action to the well head equipment and annulus is prevented; however, the amount of stratum fluid that entered will be relatively large because the time for well shut-in is long. The extra stratum fluid can cause additional pressure to the well head equipment and stratum, which makes well killing more difficult.

Presently, most blowout preventers used for the well drilling process are mounted at the well head. During the well drilling process, an arrow-shaped check valve is mounted on the drill pipe near the drill to avoid a reflux of fluid inside the drill pipe. The blowout preventer at well head is usually used to seal the annulus during drilling process and only used for well sealing when it is necessary to cut the drill pipe. When a sign of well kick is discovered, the operator turns on the control system to finish the well shut-in operation so as to avoid a blowout accident. This kind of operation relies on the experience and responsibility of the operator. However, if the operator lacks of the experience or is negligent during work, the sign of well kick or blowout may not be discovered in time, and a major accident may occur. After a well shut-in operation, the time required for well killing a well with heavy mud on the traditional well head blowout preventer is long, which results in more bottom fluid entering the well and increases the annular pressure difference, and thus it is more difficult to control blowout. Therefore, if an underground annular blowout preventer can be invented and lowered into the well together with the drill pipe, when the sign of underground well kick or blowout is discovered from the ground, the operator can operate the underground annular blowout preventer to seal the annulus and the check valve near the drill which can effectively seal the inner side of drill pipe. Thus the inner side of drill pipe and annulus over the annular preventer are in communication with each other after sealing, which facilitates the subsequent well killing operation with heavy mud. By using a check valve near the drill and an early-phase well kick pre-warning system together with the underground annular sealer, the well control principle of early-discovery and early-treatment can be realized. This operation is easier to be executed than the common well control operations.

The Chinese invention patent application which was published on 23 Jun. 2010 and named as A well blowout preventer mounted in a drilling column and automatically controlled in a well, with application number of 200910263415.7 and publication number of CN101748984A, discloses an underground preventer which can prevent blowout during well kick to a certain extent. However, it has a complex structure and many components; therefore, it is complex to install, replace, and has an accordingly high cost. After being used to prevent a blowout, the preventer can be recovered and reused from the original structure through the spring when there is no pressure difference, but if there is a pressure difference inside and outside the preventer, the preventer most likely cannot be recovered for reuse because elastic force of the spring is less than the pressure difference. After being used multiple times, the spring can easily be broken; if the spring is broken when the blowout preventer is in use, the blowout preventer cannot be recovered and taken out, and thus the blocking caused thereby brings large inconveniences to the subsequent operations.

The Chinese invention patent application which was published on 23 Aug. 2010 and named as A mechanical underground all-in-one blowout preventer, with application number of 201010148874.3 and publication number of CN101812981A, discloses an underground all-in-one blowout preventer which can prevent a blowout during well kick to a certain extent. However, it has a complex structure and uses a shearing pin to seal; the pin is used to connect the upper and lower drilling tool and transfer the torque in the well drilling process, but the pin can be broken after undertaking long periods of variable shearing forces and variable torque because the drill pipe vibrates in drilling process. Therefore, the reliability of the blowout preventer is not high since it is easy to cause an incorrect operation and due to an unexpected pin break a series of underground accidents can occur. Moreover, when it is necessary to seal the high drilling pressure, the lower drill is required to cut the pin. However, the lower drill components can only sustain a certain drilling pressure, which means that the process of cutting the pin can easily damage the lower drill components and cause an underground accident. The invention patent application has one more problem. Even if all the operations before sealing the annulus are normal, if the annulus sealing is not complete, the high pressure stratum oil and gas inside the annulus can enter the drill pipe through the flow guiding hole, which makes the arrow-shaped check valve fail to seal the inner side of the drill and makes the well control more difficult. Furthermore, after the pin is cut, well drilling has to be stopped and it is mandatory to take out the drill pipe and replace or maintain the all-in-one blowout preventer; that is, the blowout preventer can only be used once after being lowered to the well, which is unfavorable for reuse.

The Chinese invention patent application which was published on 2 Feb. 2010 and named as A lifting valve type underground inside-outside integrated blowout preventer, with application number of 200910312467.9 and publication number of CN101718181A, discloses an underground all-in-one blowout preventer which can prevent a blowout during a well kick to a certain extent. However, it has a complex structure and needs to be driven by a motor. Some problems with this invention are that it is difficult to install the motor, and a high capacity power source is required in the narrow underground space. There is doubt that whether the power provided by the motor can meet the minimum power requirements required by the sealing and unsealing processes (especially when the pressure difference is high). Therefore, the safety and reliability of the patent are not high, and it is not very practical to be used in actual well drilling.

SUMMARY OF THE PRESENT INVENTION

The invention is advantageous in that it provides

Another advantage of the invention is to provide an underground annular blowout preventer that is simple in structure, innovative in design, and high in reliability.

Another advantage of the invention is to provide an underground annular blowout preventer that can be used together with an overflow and well kick pre-warning system and a check valve near the drill, wherein when the signal of underground well kick and blowout is received from the ground, the drill rod is lowered to increase drilling pressure to a specific level, so as to seal the well quickly and realize a communication between the inner side of the drill pipe and the annulus. The pipe column is then lifted to unseal the well.

Another advantage of the invention is to provide an underground annular blowout preventer is that the present invention can effectively prevent blowout accidents, and it has high feasibility, based on the following steps:

(1) In the underground annular blowout preventer of the present invention, the torque transference between the upper and lower drill pipe is realized by the spline pair between the upper joint and the lower joint of the annular blowout preventer, so it can sustain a large torque. Each component of the blowout preventer is capable in handling a reasonable stress and is high in reliability.

(2) The underground annular blowout preventer of the present invention can be mounted into a well at different depth over the demarcation point of drill pipe, and can allow multiple realization of sealing and unsealing of the drill without need of taking out the drill pipe to replace the blowout preventer. This helps to reduce cost of the equipment and the entire well drilling process due to the reusability.

(3) Because of the first and second check valves, the underground annular blowout preventer of the present invention can prevent the high pressure fluid in the annulus from entering the drill pipe when the annular seal loses effectiveness due to other reasons.

(4) The underground annular blowout preventer of the present invention provides sealing at peripheries of the first and the second flow guiding holes with sealing member, so as to ensure that inner side of the drill pipe will not be in communication with the annulus during normal drilling process. Due to the first and second check valves, solid impurities in mud cannot damage the sealing layer and the sealing member; therefore, the service life of the sealing members is prolonged.

(5) During the well sealing process, the drill pipe can be lifted properly and lowered quickly, wherein the drill pipe is re-lowered after the drill is lifted from the bottom of well in short time, so as to seal the annular blowout preventer, and thus prevent the drill from being blocked.

(6) During the well sealing process, it is only necessary to increase drilling pressure to make the spring ejector slide into the lower moving groove from the upper moving groove, and the increased drilling pressure can be controlled within the maximum drilling pressure limit so that the lower drilling tool can be sustained, such that the lower drilling tool of the drill pipe can be protected as much as possible during the process of sealing annulus.

(7) The assembly technique of the underground annular blowout preventer of the present invention is unique in design and innovative in technique. By using the assembly technique, the sealing effect of the blowout preventer can be guaranteed. Quick sealing and unsealing are realized due to the innovative operation; furthermore, a stable and reliable structure, and a long service life of the blowout preventer are guaranteed.

Additional advantages and features of the invention will become apparent from the description which follows, and may be realized by means of the instrumentalities and combinations particular point out in the appended claims.

According to the present invention, the foregoing and other objects and advantages are attained by an underground annular blowout preventer and assembly process thereof.

In accordance with another aspect of the invention, the present invention comprises an underground annular blowout preventer, comprising an upper joint, a lower joint, a central barrel, and a rubber barrel, wherein the upper joint and the lower joint are sleeved outside a central barrel, wherein the lower end of the central barrel is fixedly connected with the lower joint, wherein the lower end of the upper joint is sleeved on the inner side of the upper end of the lower joint, wherein the upper joint is matched with the lower joint through a spline, wherein the lower end of the upper joint can move freely relative to the lower joint along the spline pair, wherein at least one rubber barrel is sleeved on the outer side of the upper joint, wherein the rubber barrel can be extruded and expanded by the upper joint and the lower joint.

Because of adopting the above structure, the upper joint is matched with the lower joint through a spline, the lower joint can rotate at the same time along with the upper joint, such that the underground annular blowout preventer of the present invention can transfer torque when it is not necessary to be used as annular blowout preventer; the lower end of the upper joint can move freely relative to the lower joint along the spline pair, so the pipe column can be lowered to move the upper joint downwards to seal the well, so as to prevent well kick or blowout. Since the lower end of the central barrel is fixedly connected with the lower joint, when the upper joint moves downwards, the rubber barrel is extruded and expanded by the upper joint and the lower joint, and thus the annulus between the drill pipe and well wall or drill pipe and the casing pipe is sealed to effectively prevent a well kick or blowout. The underground annular blowout preventer of the present invention is used with the drill, and it can realize the sealing and unsealing operation multiple times. Weight indicators can be used to monitor whether the sealing or unsealing operations are successful from the ground making it unnecessary to take out the drill pipe to replace the blowout preventer; and thus the blowout preventer can be used for multiple times, has a long service life, and a reduced cost.

A first flow guiding hole is set on the central barrel and a second flow guiding hole is set on the upper joint, wherein a sealing member is set between inner wall of the upper joint and outer wall of the central barrel, wherein the periphery of the first flow guiding hole and the periphery of the second flow guiding hole are sealed by the sealing member, such that the first flow guiding hole and the second flow guiding hole can be in butt joint with each other when the upper joint moves downwards.

Because of adopting the above structure, a sealing structure is formed at the periphery of the first flow guiding hole and the periphery of the second flow guiding hole, so as to seal the inner side of the drill pipe and the annulus. When the blowout preventer acts to transfer moment to force, the first flow guiding hole and the second flow guiding hole are both sealed by the check valve so as to prevent liquid-solid impurities from polluting the sealing surface. During the process of the upper joint moving downwards, the second flow guiding hole on the upper joint forms a butt joint with the first flow guiding hole on the central barrel, and the check valve can be opened due to the pressure difference because the periphery of the flow guiding hole is sealed, so that the drilling fluid inside the central barrel enters the annulus, which provides passage for the subsequent replacement for heavy mud lubrication operations. The blowout preventer in the drill pipe can prevent the mud from returning inside the drill pipe, and seal inner side space of the drill pipe and annulus at the same time together with the underground annular blowout preventer, so as to control occurrence of blowout and eliminate the risk.

A first check valve is set in the first flow guiding hole, and/or a second check valve is set in the second flow guiding hole.

Because of adopting the above structure, the check valve is used to prevent the drilling fluid in the annulus from entering the drill pipe when the annular seal loses effectiveness, and when the flow guiding holes are in butt joint with each other. The check valve can be opened by the fluid pressure so as to connect the inner space of the drill pipe and the annulus, and provide passage for the subsequent replacement for heavy mud lubrication operations. The check valve can also prevent solid impurities in the drilling fluid from entering the sealing layer during the normal drilling process, so as to prolong the service life of the sealing member.

A spring ejector is set on the inner side of the upper end of the upper joint, and the outer side of the central barrel close to the upper joint is provided with multiple moving grooves. When there are three moving grooves; the upper moving groove, middle moving groove, and lower moving groove from top down in order and are matched with the spring ejector; the ejector on the spring ejector can slide among the moving grooves.

Because of adopting the above structure, the ejector at the front end of the spring ejector can slide among the moving grooves. When the ejector is sliding among the moving grooves, the counteractive force from the moving groove to the ejector will be transferred to the upper drill pipe. Because the counteractive force to the ejector changes when it goes into or out of the moving grooves, the support force from the moving grooves to the upper drill pipe also changes, which results in a momentary jumping of the index of the weight indicator in the control room. By cooperation of the ejector and the moving grooves, the upward and downward movement of the upper external sleeve can be located, so as to realize effective sealing and unsealing to control well kick and blowout. By observing index change of the weight indicator on the ground, the sealing and unsealing states can be judged.

The upper joint can be made by fixedly connecting an upper joint component with an internal sleeve, or by fixedly connecting an upper connector component, an upper external sleeve, and an internal sleeve.

Because of adopting the above structure, the upper joint can be an integrated upper joint and can also be made of multiple components by fixed connections. The present invention provides multiple structural choices for the blowout preventer, with operability and multiple choices. Specific upper joint structures can be chosen according to actual requirements so as to lower production cost, reduce assembly step, and facilitate the subsequent maintenance, etc.

The spring ejector is set inside the upper joint component, and the second flow guiding hole is set on the upper joint component, wherein the lower end of the inner sleeve is sleeved on inner side of the upper end of the lower joint and the inner sleeve is in clearance fit with the lower joint through a spline, wherein the lower end of the inner sleeve can move freely relative to the lower joint along the spline pair, and the rubber barrel is sleeved outside of the inner sleeve and can be extruded and expanded by the upper joint component and the lower joint.

Because of adopting the above structure, the upper joint formed by the upper joint component and the inner sleeve makes each component of the blowout preventer able to be disassembled and assembled through matching with the lower joint and the central barrel. Thus it is very convenient to assemble, disassemble, and replace the blowout preventer, which guarantees convenient use of the preventer. The specific structure can be chosen according to actual requirement. The present invention is suitable for widespread usage.

The spring ejector is set inside the upper connector, and the second flow guiding hole is set on the upper connector, wherein the lower end of the inner sleeve is sleeved on inner side of the upper end of the lower joint, wherein the inner sleeve is in clearance fit with the lower joint through a spline, wherein the lower end of the inner sleeve can move freely relative to the lower joint along the spline pair, and the rubber barrel is sleeved outside of the inner sleeve and can be extruded and expanded by the upper connector and the lower joint.

Because of adopting the above structure, the upper joint formed by the upper connector, inner sleeve, and the outer sleeve makes each component of the blowout preventer able to be disassembled and assembled through matching with the lower joint and the central barrel. Thus it is very convenient to assemble, disassemble, and replace the blowout preventer. The cost of producing, using, and maintaining the annular blowout preventer is reduced as much as possible, and the specific structure can be chosen according to actual requirement. The present invention is suitable for widespread usage.

A convex shoulder is set outside of the central barrel, and the convex shoulder can be integrated with the central barrel, or the central barrel can be sleeved by a support sleeve and fixed outside the central barrel, wherein the support sleeve is an integrated structure or multiple pieces which are spliced together.

Because of adopting the above structure, the convex shoulder outside of the central barrel can be an integrated structure or the convex shoulder can be sleeved by the support sleeve and fixedly connected to outside of the central sleeve, wherein the present invention provides multiple structural choices for the central barrel, so as to facilitate convenient assembly according to actual requirement. The support sleeve can be integrated or spliced together with multiple pieces according to actual requirement, which is suitable for assembling of each blowout preventer structure for easy operation.

A thrust bearing is sleeved outside of the central barrel, and the thrust bearing is between the convex shoulder outside of the central barrel and the upper end surface of the inner sleeve, or the thrust bearing is between the support sleeve and the upper end face of inner sleeve.

Because of adopting the above structure, the direct friction caused by relative rotation between the central barrel and the upper external sleeve can be avoided through the thrust bearing. This relative friction is caused by the relative motion due to lack of processing precision of spline pair; however, if the underground working condition is poor, the clearance between the spline pair can be enlarged after a long period of working, so it is necessary to mount the thrust bearing which makes relative motion between the central barrel and the internal sleeve smoother, so as to reduce the torque transference between the central barrel and the internal sleeve, and to avoid reverse buckling between the central barrel and the lower external sleeve caused by spline clearance and the possible problem of the rotating velocity of the lower drill is faster than that of the upper drill.

The inner wall of the central barrel is provided with installation auxiliary hole.

Because of adopting the above structure, the installation of the auxiliary hole facilitates mounting, maintenance, and replacement of the underground annular blowout preventer of the present invention, such that it is convenient and quick to mount and maintain the blowout preventer.

The lower joint mainly comprises of a lower connector and a lower external sleeve which are fixedly connected with each other, wherein the spline inside the lower joint is located inside the lower external sleeve which is fixedly connected to lower end of the central barrel.

Because of adopting the above structure, the lower end of the lower joint is used for connecting with the drill pipe, wherein the thread on the lower end of the lower joint can be easily broken when in, use making it necessary to replace the lower joint often; however, the spline is set inside the lower joint, and it needs a high cost to process the spline inside of the lower joint. If the lower joint is divided into two parts, including the lower connector and the lower external sleeve which are fixedly connected with each other through the API drill pipe by means of threads or connected with each other through common threads, pins, and sealing members, so that the structure is stable in use. The spline is set inside of the lower external sleeve and the thread connected with the drill pipe is set on the lower connector, wherein when the thread connected with the drill pipe is broken, it is only necessary to replace the lower connector part without need for taking off the lower external sleeve and replacing the spline part, thus the maintenance cost is greatly reduced.

An assembly technique of an underground annular blowout preventer, comprising the following steps:

1201, fixing the inner sleeve, embedding multiple spacer rings and the rubber barrel outside of the inner sleeve along the thread direction at the upper end of the inner sleeve, such that the spacer rings and the rubber barrel are limited over the spline outside the internal sleeve;

1202, embedding the thrust bearing inside the upper external sleeve from the lower end thereof, and tightening the lower end of the upper external sleeve and the upper end of the inner sleeve to the predetermined torque after butt jointed with each other;

1203, embedding the first check valve and the second check valve separately on the side walls of the central barrel and the upper external sleeve, and tightening to the predetermined torque, embedding the sealing member to the relevant position of the central barrel while preventing the sealing member from being scratched when passing through the central barrel, and mounting the central barrel from top of the upper external sleeve and the inner sleeve;

1204, embedding the lower joint to the outside of the central barrel and the inner sleeve along the spline pair, stretching the outward expanding tool to inner side of the central barrel and blocking the tool into the installation auxiliary hole, fixing the lower joint while rotating the central barrel, or fixing the central barrel while rotating the lower joint so as to tighten the thread pair between lower end of the central barrel and the lower joint to the predetermined torque;

1205, embedding the spring ejector inside the upper connector, inserting the upper connector into the central barrel along the outer wall thereof, fixing the upper external sleeve while rotating the upper connector, or fixing the upper connector while rotating the upper external sleeve so as to tighten the thread pair between the upper connector and the upper external sleeve to the predetermined torque, such that the ejector on the spring ejector slides into the upper moving groove of the central barrel during the downward movement process of the upper connector.

Because of adopting the above structure, the blowout preventer can be assembled quickly. When the accessories are broken, they can be replaced by reverse disassembling. The assembling technique is innovative in that the blowout preventer assembled by this technique is stable and reliable in structure and can effectively prevent well kick and blowout. The assembling technique of the blowout preventer is unique in design and innovative in technique; it can guarantee a good sealing effect and the assembled blowout prevent has an innovative operation able to quickly realize sealing and unsealing. It is stable and reliable in structure and has a long service life.

An assembly technique of an underground annular blowout preventer, comprising the following steps:

1301, fixing the inner sleeve, embedding multiple spacer rings and the rubber barrel outside of the inner sleeve along the thread direction on the upper end of the inner sleeve, such that the spacer rings and the rubber barrel are limited above the convex shoulder at the middle of the inner sleeve;

1302, mounting the first check valve on the support sleeve and embedding the spring ejector to the inner wall of the upper joint component, embedding the support sleeve inside the upper joint component from the lower end thereof and embedding the thrust bearing inside the upper joint component from the lower end thereof, and fixedly connecting the lower end of the upper joint component and the upper end of the inner sleeve;

1303, embedding the central barrel body into the inner sleeve from the lower end thereof and passing through the support sleeve, and fixedly connecting the central barrel body with the support sleeve;

1304, embedding the lower joint into the central barrel body along the lower end of the central barrel body and the external spline end of the internal sleeve, stretching the outward expanding tool to inner side of the central barrel body and blocking the tool into the installation auxiliary hole, fixing the lower joint while rotating the central barrel body, or fixing the central barrel body while rotating the lower joint, so as to tighten the thread pair between the central barrel body and the lower joint to the predetermined torque, such that the ejector on the spring ejector slides into the upper moving groove of the central barrel body during the downward movement process of the upper joint component.

Because of adopting the above structure, the blowout preventer can be assembled quickly when the accessories are broken, and they can be replaced by reverse disassembling. The assembling technique is innovative, and the blowout preventer assembled by this technique is stable and reliable in structure and can effectively prevent well kick and blowout. Additionally, the assembling technique of the blowout preventer is unique in design and innovative in technique, it can guarantee a good sealing effect and the innovative action of the assembled blowout preventer allows for quick realization in sealing and unsealing. It is stable and reliable in structure, and has a long service life.

An assembly technique of an underground annular blowout preventer, comprising the following steps:

1401, embedding the first check valve into the first flow guiding hole on the support sleeve which is made by splicing multiple pieces, embedding the thrust bearing which is made by splicing multiple pieces into the cavity of the upper joint and embedding the support sleeve into the cavity of the upper joint over the thrust bearing;

1402, embedding the spring ejector into the inner wall of the upper end of the upper joint, sleeving the rubber sleeve and the spacer ring in order on the middle part outside the upper joint, embedding the central barrel body into the upper joint from the lower end thereof and passing through the support sleeve, fixedly connecting the central barrel body and the support sleeve, embedding the second check valve into the second flow guiding hole on the upper joint;

1403, embedding the lower joint along the external spline end at the lower end of the central barrel body and the lower end of the upper joint, stretching the outward expanding tool to inner side of the central barrel body and blocking the tool into the installation auxiliary hole, fixing the lower joint while rotating the central barrel body, or fixing the central barrel body while rotating the lower joint, so as to tighten the thread pair between lower end of the central barrel body and the lower joint to the predetermined torque, such that the ejector on the spring ejector slides into the upper moving groove of the central barrel body during the downward movement process of the upper joint.

Because of adopting the above structure, the blowout preventer can be quickly assembled when the accessories are broken, and they can be replaced by reverse disassembling. The assembling technique is innovative, the blowout preventer assembled by this technique is stable and reliable in structure, and can effectively prevent well kick and blowout. The assembling technique of the blowout preventer is unique in design and innovative in technique in that it can guarantee a good sealing effect and an innovative operation of the assembled blowout preventer in quickly realizing the sealing and unsealing. It is stable and reliable in structure and has a long service life.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

All features, methods, or steps published in the specification, except the features and/or steps which are repellent to each other, can be combined for use in any way.

The specification includes all features published in any additional claims, abstracts and drawings; unless described specially, all features can be replaced by other substitutable features which have equivalent effect or similar target. That is, unless described specially, each feature is only one example of the series of equivalent or similar features.

Embodiment 1

Figure 1:
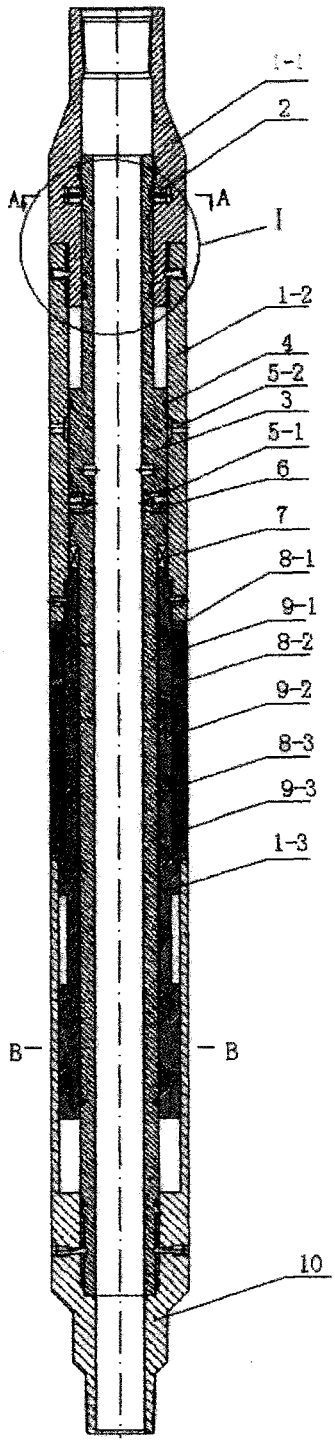
FIG. 1 is a structural schematic diagram of embodiment 1 of the underground annular blowout preventer of the present invention.
Figure 2:
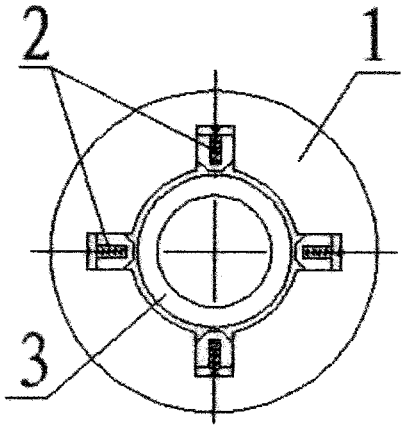
FIG. 2 is A-A view of FIG. 1.
Figure 3:
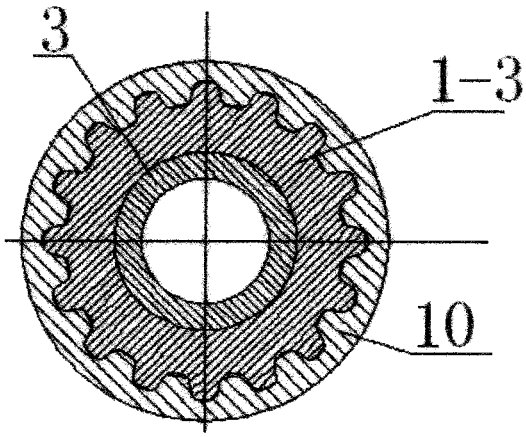
FIG. 3 is B-B view of FIG. 1.
Figure 4:
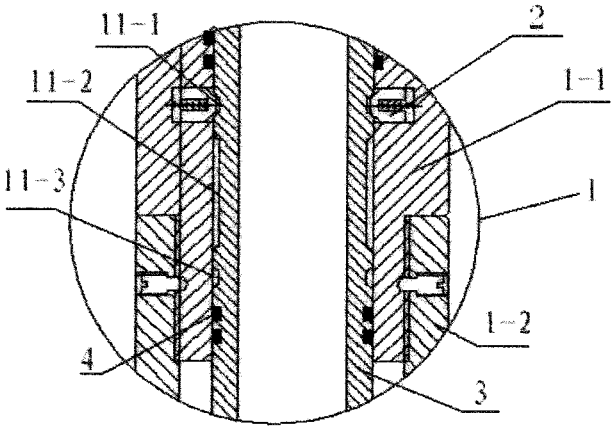
FIG. 4 is partial enlarged drawing of the Part I in FIG. 1.
Figure 5:
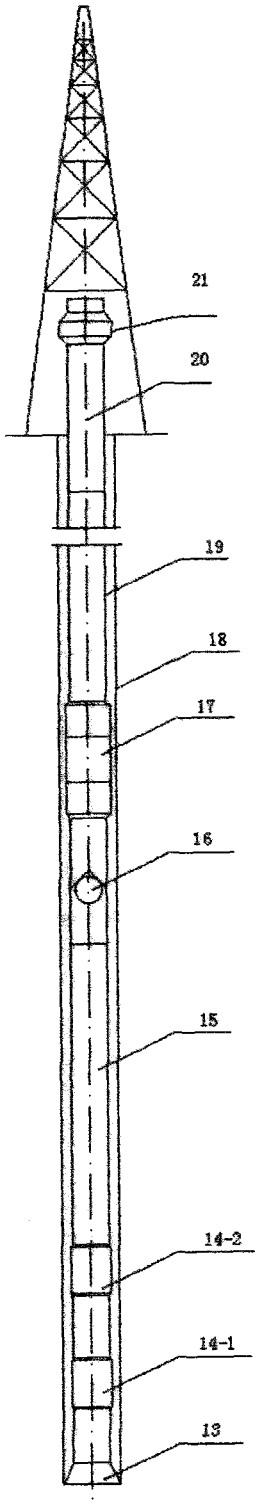
FIG. 5 is structural schematic diagram of the drill pipe equipped with the underground annular blowout preventer of the present invention.

The embodiment of the underground annular blowout preventer claimed in the present invention, as illustrated in FIGS. 1, 2, 3 and 4, comprises an upper connector 1-1 and a lower joint 10 which are sleeved outside of the central barrel 3, wherein the lower end of the central barrel 3 is fixedly connected with the lower joint 10 through API drill pipe by means of threading or connected with each other through common threading, pin, and sealing member, wherein a spring ejector 2 is set on the inner side of the upper connector 1-1, and the upper end of the central barrel 3 is provided with three moving grooves including upper moving groove 11-1, middle moving groove 11-2 and lower moving groove 11-3, wherein the moving grooves are used to match with the spring ejector 2, and more grooves can be set according to actual requirement, wherein while in use, every time the annular blowout preventer enters one state (lowering to seal or lifting to unseal), components like the upper connector 1-1 should also be lowered or lifted along with the upper connector 1-1, and the ejector at the front end of the spring ejector 2 slides among the upper moving groove 11-1, the middle moving groove 11-2, and the lower moving groove 11-3, wherein every time when the ejector slides into or out of the moving grooves, the index of the weight indicator on the ground will fluctuate, which provides a signal feedback of the annular blowout preventer status for the control personnel on the ground to control, wherein when using the sealing function of the annular blowout preventer, the drill is lowered and the upper connector 1-1 moves downwards, while the spring ejector 2 moves from the upper moving groove 11-1 to the middle moving groove 11-2, the index of the weight indicator fluctuates (it becomes smaller and then bigger), wherein because the middle moving groove 11-2 is wider, the ejector of the spring ejector 2 slides to the lower end of the middle moving groove 11-2 when the upper connector 1-1 moves downwards, wherein during the long displacement, the index of weight indicator barely changes, wherein when the upper connector 1-1 moves downwards continuously, ejector of the spring ejector 2 slides to the lower moving groove 11-3 from the middle moving groove 11-2, and the index of the weight indicator fluctuates again (it becomes smaller and then bigger) and becomes stable, which means the preventer sealed successfully; there are multiple match methods for the moving grooves and the spring ejector, for example, round groove matching with spherical ejector, V-shaped groove matching with trapezoidal ejector, rectangular groove matching with trapezoidal ejector and so on. Both ends of the three moving grooves are provided with sealing member 4 which is between the upper connector 1-1 and the central barrel 3, so as to seal the moving grooves inside to prevent solid impurities in mud from polluting the lubricating environment of the moving groove and to prevent the stressing effect from being changed. There are two or more spring ejectors uniformly distributed along the outer wall of the central barrel 3, so as to ensure uniform stressing on the part between the central barrel 3 and the upper connector 1-1, and avoid eccentric problems caused by downward movement of the upper connector 1-1. The upper external sleeve 1-2 is fixedly connected to the lower end of the upper connector 1-1 through API drill pipe by means of threading or through a common threading, pin, and sealing member, wherein during well drilling process, the lower end of the central barrel 3 will be tightened more and more with the lower joint 10, so as to ensure safety and to prevent reverse buckling. Alternatively, the upper external sleeve 1-2 can be integrated with the upper connector 1-1 to ensure convenient use, stable structure, and using safety. The upper external sleeve 1-2 is sleeved outside of the central barrel 3, and a second flow guiding hole 5-2 is set on the upper external sleeve 1-2, while a first flow guiding hole 5-1 is set on the relevant position on the central barrel 3. A second check valve 6-2 is set in the second flow guiding hole 5-2, and a first check valve 6-1 is set in the first flow guiding hole 5-1. When the upper external sleeve 1-2 moves downwards, the second flow guiding hole 5-2 can be butt jointed with the first flow guiding hole 5-1. Sealing members 4 are set over and below both flow guiding holes, so as to seal the peripheries of the first flow guiding hole 5-1 and the second flow guiding hole 5-2. Because the check valve can obstruct solid impurities in the drilling fluid, the sealing layer and sealing member between the upper external sleeve 1-2 and the central barrel 3 are protected from being damaged by the solid impurities in the drilling fluid during normal drilling process, so as to guarantee sealing effect and service life. The lower end of the upper external sleeve 1-2 is provided with the inner sleeve 1-3 inside by means of a fixed connection through the API drill pipe joint threading or through a common thread, pin, and sealing member. The inner sleeve 1-3 is sleeved outside of the central barrel 3, and a first spacer ring 8-1, a first rubber barrel 9-1, a second spacer ring 8-2, a second rubber barrel 9-2, a third spacer ring 8-3, a third rubber barrel 9-3, and a fourth spacer ring 8-4 are sleeved outside of the central barrel 3 to form a rubber component. Both ends of the rubber barrel component are respectively in contact with lower end face of the upper external sleeve 1-2 and upper end face of the lower joint 10, wherein the lower end of inner sleeve 1-3 is sleeved between the lower joint 10 and the central barrel 3, and lower end of inner sleeve 1-3 is matched with the middle part of inner wall of the lower joint 10 through a spline (as shown in FIG. 3), such that lower end of inner sleeve 1-3 can move up and down freely relative to the lower joint 10 and the central barrel 3 along the spline within a certain displacement range, wherein only in this way can the relative distance between the upper external sleeve 1-2 and the lower joint 10 can be reduced, so as to keep enough space for rubber barrel to expand after being pressed or rebounded so that the rubber barrel can seal and unseal the annulus. During the normal drilling process, the torque transferred from the upper connector 1-1 can be transferred to the lower joint 10 and lower drill through the spline pair, such that the drill can be driven to rotate. One or more rubber barrel components can be formed by the rubber barrel and each rubber barrel combination, with a length and number thereof being determined according to actual requirement. Sealing members 4 are set between the inner sleeve 1-3 and the central barrel 3, and the inner sleeve 1-3 and the lower joint 10; because the lower joint 10 is provided with a spline which requires a high processing cost, and the threading of the lower end of the lower joint 10, which is used to connect drill pipe, can be easily damaged. This cost is increased if the lower joint 10 is replaced because the threading is damaged; therefore, the lower joint 10 can be divided into the lower connector 10-1 and the lower external sleeve 10-2 which are fixedly connected with each other through the API drill pipe by means of threading or connected with each other through a common thread, pin, and sealing member. When the thread connected with the drill pipe is broken, it is only necessary to disassemble and replace the lower connector 10-1, and thus the maintenance cost is greatly reduced. To facilitate installation of the annular blowout preventer, the installation auxiliary hole is provided on the inner wall of the central barrel 3 so that a special tool can be inserted into the central barrel 3 to tighten the central barrel 3 and the lower joint 10 by fixing or rotating the central barrel 3. Through the thrust bearing 7, relative rotation between the central barrel 3 and the upper external sleeve 1-2 can be avoided. Although the relative motion is caused by the relative motion due to the lack of processing precision of the spline pair and poor underground working conditions, the clearance between the spline pair can be enlarged after long-term operation. It is necessary to mount the thrust bearing 7 between the convex shoulder of the central barrel 3 and the upper end of the inner sleeve 1-3, so as to make the relative motion between the central barrel 3 and the internal sleeve 1-3 smoother, reduce the torque transference between the central barrel 3 and the internal sleeve 1-3, and avoid reverse buckling between the central barrel 3 and the lower external sleeve 10-2 caused by spline clearance and the possible problem that the rotating velocity of the lower drill is faster than that of the upper drill. A step is provided at outside of the upper end of the central barrel 3, and there is stroke space between the step and end face of the upper connector 1-1; the inner side of upper end of the lower joint 10 is step-shaped so that the inner sleeve 1-3 can be set inside the lower joint 10, and there is stroke space between the end face of the inner sleeve 1-3 and the step inside the lower joint 10. The distance between each stroke space is equal to the distance between the first flow guiding hole 5-1 and the second flow guiding hole 5-2, such that the annular blowout preventer of the present invention is compact in structure. The step can be sleeved by the support sleeve 12 and fixedly connected outside the central barrel 3.

The drill column of the present invention is installed with the underground annular blowout preventer, wherein the blowout preventer is mounted to the drill column at the position above the neutral point of the drill column which is in the sleeve or well wall. The drill 13 is at the bottommost end of the drill column, and the two pressure detecting and signal generators, namely the first pressure detecting and signal generator and the second pressure detecting and signal generator, are set above the frill. The drill collar 15 is set above the two pressure detecting devices, and a blowout preventer inside drill column 16 is set above the drill collar 15. The underground annular blowout preventer of the present invention is mounted at the position above the neutral point of the drill column which is above the drill collar 15, because the neutral point is the tensioned and distressed demarcation point of drill column and the annular blowout preventer is set above the neutral point, the annular blowout preventer is in a distressed state during the normal well drilling process; that is, the upper connector 1-1, the upper external sleeve 1-2, and the inner sleeve 1-3 are all in the distressed state, and the upper external sleeve 1-2 and the lower joint 10 have not been extruded in the rubber barrel. Because the lower end of the inner sleeve is matched with the lower joint 10 through the spline, the drill column on the upper end of the blowout preventer can transfer the torque to lower end of the drill column through the spline; therefore, the underground annular blowout preventer of the present invention can effectively prevent well kick or blowout. When the blowout preventer is not being used to seal the well, it can be used to transfer torque. The underground annular blowout preventer of the present invention is lowered to seal and lifted to unseal, so the present invention is suitable for reuse. There is kelly bar (driven by rotary disk) or drill column (top drive) on top of the drill column, and a signal receiver 21 is set on the upper end of the kelly bar or the lower end of the drill pipe. The signal receiver 21 is wirelessly connected with an alarm, and is matched with the pressure detecting device near the drill to send and receive signals separately; the signal can be sound waves, electromagnetic waves, optical waves, and so on.

The assembly technique of the underground annular blowout preventer of the present invention comprises the following steps:

a.) fixing the inner sleeve 1-3, embedding multiple spacer rings and the rubber barrel outside of the inner sleeve 1-3 along the thread direction of the inner sleeve 1-3, such that the spacer rings and the rubber barrel are limited over the embossment or the step (namely, over the spline) outside the internal sleeve 1-3;

b.) embedding the thrust bearing 7 inside the upper external sleeve 1-2 from the lower end thereof, and tightening the lower end of the upper external sleeve 1-2 and the upper end of the inner sleeve 1-3 to the preset torque after butt jointed with each other;

c.) embedding the check valve 6 to the side wall of the central barrel, tightening to the predetermined torque, embedding the sealing member 4 to the predetermined position of the central barrel 3 while preventing the sealing member 4 from being scratched when passing through the central barrel 3, and mounting the central barrel 3 from top of the upper external sleeve 1-2 and the inner sleeve 1-3;

d.) embedding the lower joint 10 to outside of the central barrel 3 and the inner sleeve 1-3 along the spline pair of the inner sleeve 1-3, stretching the outward expanding tool to inner side of the central barrel 3 and blocking the tool into the installation auxiliary hole which is preset in the central barrel 3, fixing the lower joint 10 while rotating the central barrel 3, or fixing the central barrel 3 while rotating the lower joint 10 so as to tighten the thread pair between lower end of the central barrel and the lower joint to the predetermined torque, stretching the outward expanding tool to inner side of the central barrel 3 and blocking the tool into the installation auxiliary hole which is preset in the central barrel 3, screwing the part without the spline to thread pair of the central barrel 3, and tightening to the predetermined torque; if common thread is used, mounting a sealing member in addition and further using a pin to fix them after tightening the thread to the predetermined torque; if a common thread is used, mounting a sealing member in addition and further using a pin to fix them after tightening the thread to the predetermined torque; if a separate lower joint 10 is used, embedding the part of lower joint 10 with spline to outer side of the central barrel 3 and inner sleeve 1-3 along the spline pair of the inner sleeve 1-3;

e.) embedding the spring ejector 2 inside the upper connector 1-1, inserting the upper connector 1-1 into the central barrel 3 along the outer wall thereof, the ejector at front of the spring ejector 2 is pressed into the relevant position of the upper connector 1-1 by the outer wall of the central barrel 3 when the upper connector 1-1 is moving downwards, when the lower end of the upper connector 1-1 is in contact with the upper end of the external sleeve 1-2, rotating the central barrel 3 or the upper connector 1-1 so as to tighten the upper connector 1-1 and the upper external sleeve 1-2 to the predetermined torque;

f.) mounting the assembled blowout preventer to the drill column at the position above neutral point thereof.

During the well drilling process, when there is a high pressure oil reservoir or oil reservoir, the working method of the drill column assembled with the underground annular blowout preventer of the present invention comprises the following steps:

1.) The first pressure detecting and signal generator 14-1 and/or the second pressure detecting and signal generator 14-2 detect/detects the underground pressure signal, and compare/compares the signal with the preset program; when the pressure signal indicates abnormal pressure, the signal triggering device on the first pressure detecting and signal generator 14-1 and/or the second pressure detecting and signal generator 14-2 is switched on and sends an abnormal pressure signal (the signal can be a sound wave, an electromagnetic wave, an optical wave and so on); the signal is then transmitted upwards along the drill pipe, and the signal receiver 21 mounted on the upper end of the kelly bar or on the lower end of top drive receives the signal and sends a warning signal to the alarm, and the alarm sends out warning sound;

2.) when the alarm sounds, the drill column is lowered manually or automatically, so the drilling pressure is increased, and the upper connector 1-1, upper external sleeve 1-2, and inner sleeve 1-3 are pressed and move downwards at the same time; the rubber barrel sleeved on the inner sleeve 1-3 is expanded under the extruding force of the upper external sleeve 1-2 and the lower joint 10, so as to seal the annulus between the drill column and well wall, or drill column and sleeve; during the downward movement process of the upper connector 1-1, upper external sleeve 1-2, and inner sleeve 1-3; the spring ejector 2 is squeezed out of the upper moving groove 11-1 by the central barrel 3 and enters the middle moving groove 11-2, at this time, index of the weight indicator in the control room fluctuates once; the drill column is lowered continuously, and the upper connector 1-1, upper external sleeve 1-2, and inner sleeve 1-3 also move downwards continuously; the spring ejector 2 enters the lower moving groove 11-3 after finishing sliding in the middle moving groove 11-2, at this time, index of the weight indicator in the control room fluctuates once again, and then the blowout preventer is in sealing state; during the downward movement process of the upper connector 1-1, the flow guiding hole on the upper external sleeve 1-2 forms a butt joint with the check valve 6 on the central barrel, and the check valve 6 will be opened by the fluid pressure, thus the inner space of drill column is in communication with the annulus, so as to provide passage for subsequent well killing operation when there is heavy mud. The blowout preventer inside drill column 16 on the drill column can prevent the mud inside the drill column from returning upwards, and co-working with the underground blowout preventer can also seal the inner side of the drill column and the annulus, so as to control occurrence of blowout;

3.) when the blowout is controlled, the drill column is lifted up and the drilling pressure is reduced, and the upper connector 1-1, upper external sleeve 1-2, and inner sleeve 1-3 move upwards at the same time, the rubber barrel sleeved on the inner sleeve 1-3 are not extruded but released, so the sealing is relieved; during the upward movement process of the upper connector 1-1, upper external sleeve 1-2, and inner sleeve 1-3; the spring ejector 2 is squeezed out of the lower moving groove 11-3 by the central barrel 3 and enters the middle moving groove 11-2, at this time, index of the weight indicator in the control room fluctuates once; the drill column is lifted continuously, the upper connector 1-1, upper external sleeve 1-2, and inner sleeve 1-3 then move upwards continuously, the spring ejector 2 enters the upper moving groove 11-1 after finishing sliding in the middle moving groove 11-2, at this time, index of the weight indicator in the control room fluctuates once again, then sealing of blowout preventer is relieved; during the upward movement process of the upper connector 1-1, the butt joint of the flow guiding hole on the upper external sleeve 1-2 with the check valve 6 on the central barrel is relieved, and the check valve 6 will be closed; thus the blowout preventer can be reused and the torque from the upper part of the drill column is transferred downwards through the blowout preventer, so as to realize continuous drilling.

Embodiment 2

Figure 8:
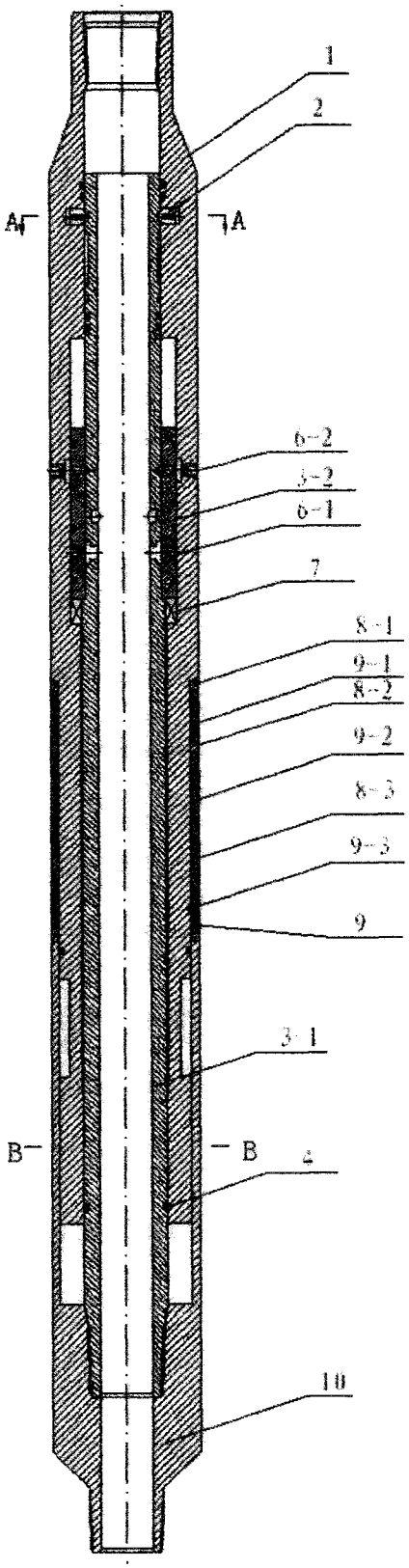
FIG. 8 is structural schematic diagram of the embodiment 2 of the underground annular blowout preventer of the present invention.

Embodiment 2 is similar with the Embodiment 1, as shown in FIG. 8, the difference is as follows: the upper connector 1-1, upper external sleeve 1-2, and inner sleeve 1-3 are integrated to form the upper joint 1, and lower end of the upper joint 1 is embedded between the lower joint 10 and the central barrel 3. The outer wall of the upper joint 1 is matched with the inner wall of the lower joint through a spline, and the upper joint 1 able to move relative to the lower joint 10 along the spline pair. The lower joint 10 rotates along with the upper joint 1 at the same time, and outer side of the upper joint 1 is provided with an embossment or step. A rubber barrel 9 is sleeved outside the upper joint 1 which is under the embossment or step, and the rubber barrel 9 can be extruded and expanded by the end face of the upper joint 1 and the end face of the lower joint 10. The second flow guiding hole is set on the upper joint 1, and a second check valve 6-2 is set inside the second flow guiding hole 5-2. When the upper joint 1 moves downwards, the first flow guiding hole 5-1 can be butt jointed with the second flow guiding hole 5-2. The spring ejector 2 is set on the inner side of upper end of the upper external sleeve 1-2 and matched with the moving groove on the central barrel 3. The central barrel 3 comprises primarily of the central barrel body 3-1 and support sleeve 3-2 which are fixedly connected with each other, and the support sleeve 3-2 is fixedly connected on the outer wall of the central barrel body 3-1. Both the support sleeve 3-2 and the thrust bearing 7 are an integrated structure or made by splicing three or more pieces together, so as to facilitate installation. The support sleeve 3-2 is used to support the thrust bearing 7 and upper end of the upper joint 1, such that the blowout preventer is always in a distressed state when in use, but will not fall off to ensure the user's safety. Through the thrust bearing 7, the relative rotation between the central barrel 3 and the upper external sleeve 1-2 can be avoided during the well drilling process. Although the relative motion is caused by the relative motion due to lack of processing precision of the spline pair and poor underground working conditions, the clearance between the spline pair can be increased after long-term operation, so it is necessary to mount the thrust bearing 7 between the convex shoulder of the central barrel 3 and the upper end of the inner sleeve 1-3, so as to make relative motion between the central barrel 3 and the internal sleeve 1-3 smoother, reduce the torque transference between the central barrel 3 and the internal sleeve 1-3, and avoid reverse buckling between the central barrel 3 and the lower external sleeve 10-2 caused by the spline clearance and possible problem of the rotating velocity of the lower drill being faster than that of the upper drill.

The drill column of the present invention is installed with the underground annular blowout preventer, wherein the blowout preventer is mounted to the drill column at the position above the neutral point of the drill column. Because the neutral point is the tensioned and distressed demarcation point of drill column and the annular blowout preventer is set above the neutral point, the annular blowout preventer is in a distressed state during the normal well drilling process. The upper joint 1 of the underground annular blowout preventer is in the distressed state, and lower end of the upper joint 1 is matched with the lower joint 10 through the spline, and the drill column on the upper end of the blowout preventer can transfer the torque to lower end of the annular blowout preventer through the spline. The underground annular blowout preventer of the present invention can effectively prevent well kick or blowout. When the blowout preventer is not used to seal the well, it can be used to transfer torque. The underground annular blowout preventer of the present invention is lowered to seal and lifted to unseal, so the present invention is suitable for reuse. There is a kelly bar (driven by rotary disk) or drill column (top drive) on top of the drill column, and a signal receiver 21 is set on the upper end of the kelly bar or the lower end of the drill pipe. The signal receiver 21 is wirelessly connected with an alarm, and the signal receiver 21 is matched with the pressure detecting device near the drill to send and receive signal separately.

The assembly technique of the underground annular blowout preventer of the present invention comprises the following steps:

1.) embedding the first check valve 6-1 into the first flow guiding hole 5-1 on the support sleeve 3-2 which is made by splicing multiple pieces, embedding the thrust bearing 7 which is made by splicing multiple pieces into the cavity of the upper joint 1, and embedding the support sleeve 3-2 into the cavity of the upper joint 1 over the thrust bearing 7;

2.) embedding the spring ejector 2 into the inner wall of the upper end of the upper joint 1, sleeving the rubber sleeve 9 and the spacer ring 8 in order on the middle part outside the upper joint 1, embedding the central barrel body 3-1 into the upper joint 1 from the lower end thereof, and passing through the support sleeve 3-2, and fixedly connecting the central barrel body 3-1 and the support sleeve 3-2;

3.) embedding the lower joint 10 along the external spline end at the lower end of the central barrel body 3-1 and the lower end of the upper joint 1, stretching the outward expanding tool to the inner side of the central barrel body 3-1 and blocking the tool into the installation auxiliary hole, fixing the lower joint 10 while rotating the central barrel body 3-1, or fixing the central barrel body 3-1 while rotating the lower joint 10, so as to tighten the thread pair between the lower end of the central barrel body 3-1 and the lower joint 10 to the predetermined torque, such that the ejector on the spring ejector 2 slides into the upper moving groove 11-1 of the central barrel body 3-1 during the downward movement process of the upper joint 1;

4.) mounting the assembled blowout preventer to the drill column at the position above neutral point thereof.

During the well drilling process, when there is a high pressure oil reservoir or oil reservoir, the working method of the drill column assembled with the underground annular blowout preventer of the present invention is the same as the operating method of Embodiment 1.

Embodiment 3

Figure 6:
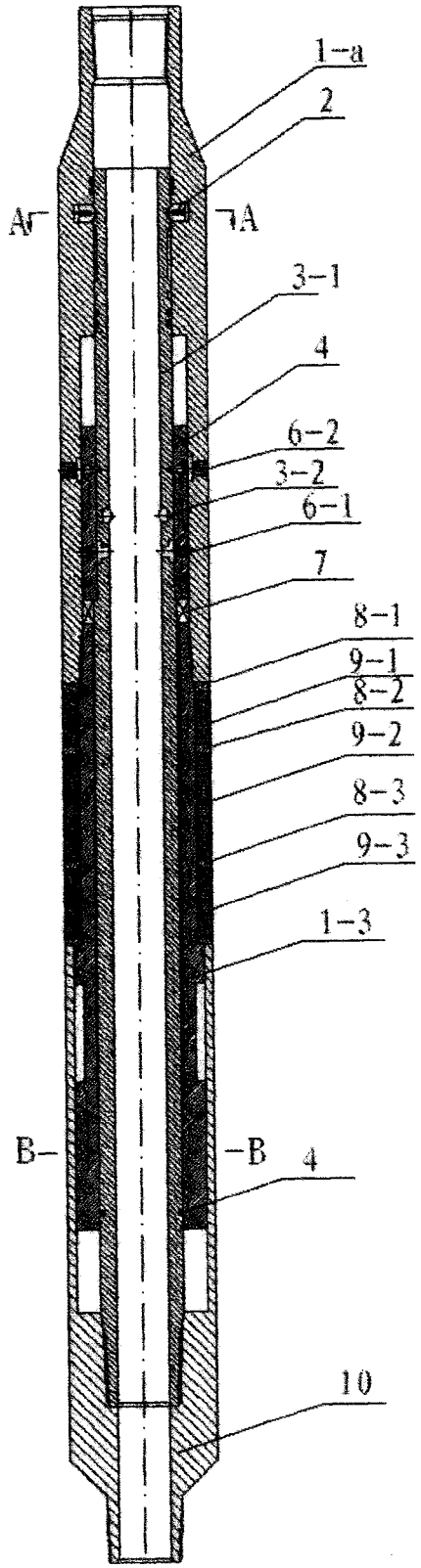
FIG. 6 is structural schematic diagram of the embodiment 3 of the underground annular blowout preventer of the present invention.
Figure 7:
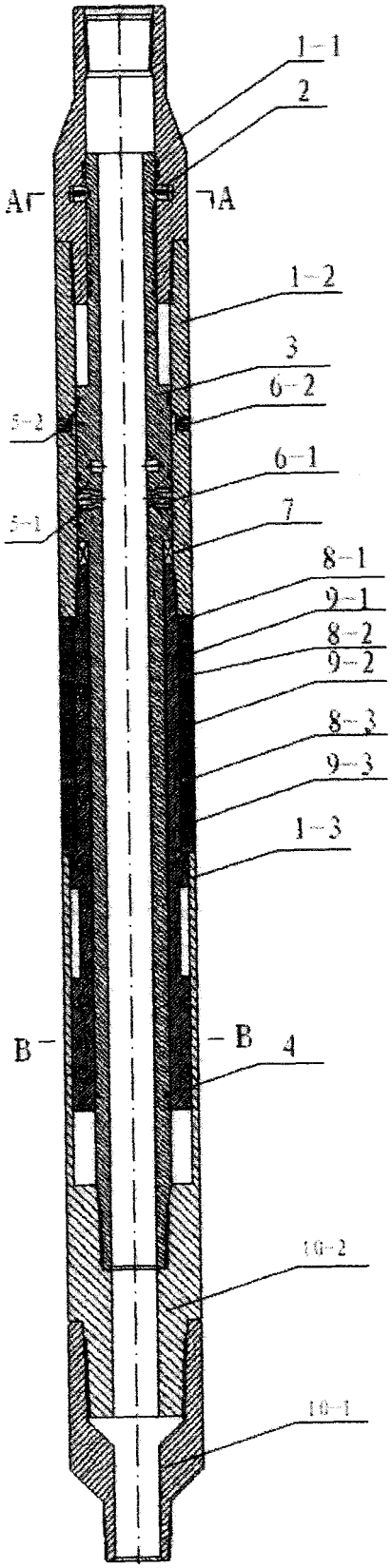
FIG. 7 is another structural schematic diagram of the embodiment 1 of the underground annular blowout preventer of the present invention.

Embodiment 3 is similar to the Embodiments 1 and 2, as shown in FIG. 6, the difference is as follows:

The upper connector 1-1 is integrated with the upper external sleeve 1-2 to form the upper joint component 1-*a*, and an inner sleeve 1-3 is fixedly connected inside the lower end of the upper joint component 1-*a*. The inner sleeve 1-3 is sleeved outside of the central barrel body 3-1, and lower end of the inner sleeve 1-3 is embedded between the lower joint 10 and the central barrel body 3-1. The outer wall of the lower end of the inner sleeve 1-3 is matched with the upper joint component 1-*a* through a spline, and the inner sleeve 1-3 can move freely relative to the lower joint 10 along the spline pair. A rubber barrel 9 is sleeved outside of the inner sleeve 1-3, and the upper end of which is embedded inside the upper joint component 1-*a*; therefore, both ends of the sleeve are in contact with the lower end face of the upper joint component 1-*a* and the upper end face of the lower joint, and the rubber barrel 9 can be extruded and expanded by lower end face of the upper joint component 1-*a* and upper end face of lower joint. The second check valve 6-2 is set on the upper joint component 1-*a*, and when the upper joint component 1-*a* moves downwards, the first flow guiding hole 5-1 can be butt jointed with the second flow guiding hole 5-2. The first flow guiding hole 5-1 is set with a first check valve 6-1, and the second check valve 6-2 is set inside the second flow guiding hole 5-2. The spring ejector 2 is set inside the upper end of the upper joint component 1-*a* and matched with the moving grooves on the central barrel body 3-1. A support sleeve 3-2 is fixedly connected to the outer wall of the central barrel body 3-1 to support the thrust bearing and lower end of the upper joint component 1-*a*, such that the blowout preventer is always in a distressed state when in use, but will not fall off to ensure the user's safety. Through the thrust bearing 7, relative rotation between the central barrel 3 and the upper joint component 1-*a* can be avoided during the well drilling process. Although the relative motion is caused by the relative motion due to lack of processing precision of the spline pair and poor underground working conditions, the clearance between the spline pair can be increased after long-term operation. It is necessary to mount the thrust bearing 7 between the convex shoulder of the central barrel 3 and the upper end of the inner sleeve 1-3, so as to make relative motion between the central barrel 3 and the internal sleeve 1-3 smoother, reduce the torque transference between the central barrel 3 and the internal sleeve 1-3, and avoid reverse buckling between the central barrel 3 and the lower external sleeve 10-2 caused by the spline clearance and the possible problem of the rotating velocity of the lower drill being faster than that of the upper drill.

The drill column of the present invention is installed with the underground annular blowout preventer, wherein the blowout preventer is mounted to the drill column at the position above the neutral point of the drill column. Because the neutral point is the tensioned and distressed demarcation point of drill column and the annular blowout preventer is set above the neutral point, the annular blowout preventer is in a distressed state during the normal well drilling process. The upper joint component 1-*a* of the underground annular blowout preventer is in the distressed state, and the lower end of the upper joint component 1-*a* is matched with the lower joint 10 through the spline. The drill column on the upper end of the blowout preventer can transfer the torque to lower end of the annular blowout preventer through the spline; therefore, the underground annular blowout preventer of the present invention can effectively prevent well kick or blowout, and when the blowout preventer is not used to seal the well it can be used to transfer torque. The underground annular blowout preventer of the present invention is lowered to seal and lifted to unseal, so the present invention is suitable for reuse. There is a kelly bar (driven by rotary disk) or drill column (top drive) on top of the drill column, and a signal receiver 21 is set on the upper end of the kelly bar or the lower end of the drill pipe. The signal receiver 21 is wirelessly connected with an alarm, and the signal receiver 21 is matched with the pressure detecting device near the drill to send and receive signals separately.

The assembly technique of the underground annular blowout preventer of the present invention comprises the following steps:

1.) fixing the inner sleeve 1-3, sleeving multiple spacer rings 8 and the rubber barrel 9 outside of the inner sleeve 1-3 along the thread direction on the upper end of the inner sleeve 1-3, and limiting the multiple spacer rings 8 and the rubber barrel 9 to upside of the convex shoulder at the middle of the inner sleeve 1-3;

2.) embedding the first check valve 6-1 to the support sleeve 3-2, embedding the spring ejector 2 to the inner wall of the upper joint component 1-*a*, embedding the support sleeve 3-2 into upper joint component 1-*a* from the lower end thereof, embedding the thrust bearing 7 into the upper joint component 1-*a* from the lower end thereof, and fixedly connecting the lower end of the upper joint component 1-*a* and the upper end of the inner sleeve 1-3;

3.) embedding the central barrel body 3-1 into the inner sleeve 1-3 from the lower end thereof and passing through the support sleeve 3-2, fixedly connecting the central barrel body 3-1 and the support sleeve 3-2, and embedding the second check valve 6-2 to the inner wall of the upper joint component 1-*a;*

4.) embedding the lower joint 10 along the lower end of the central barrel body 3-1 and the external spline end of the inner sleeve 1-3, stretching the outward expanding tool to the inner side of the central barrel body 3-1 and blocking the tool into the installation auxiliary hole, fixing the lower joint 10 while rotating the central barrel body 3-1, or fixing the central barrel body 3-1 while rotating the lower joint 10, so as to tighten the thread pair between the lower end of the central barrel body 3-1 and the lower joint 10 to the predetermined torque, such that the ejector on the spring ejector 2 slides into the upper moving groove 11-1 of the central barrel body 3-1 during the downward movement process of the upper joint 1;

5.) mounting the assembled blowout preventer to the drill column at the position above the neutral point thereof.

During the well drilling process, when there is a high pressure oil reservoir or oil reservoir, the working method of the drill column assembled with the underground annular blowout preventer of the present invention is the same as the operating method of Embodiments 1 and 2.

To sum up, in the underground annular blowout preventer of the present invention, the upper joint can be an integrated structure or separated component structure and the lower end can also be an integrated structure or a structure formed by fixedly connecting lower connector 10-1 and lower external sleeve 10-2, so as to provide different options for specific requirements in different situations. In the present invention, connections between each component of separate upper joint can be either fixed connections through the API drill pipe joint thread or connections through a common thread together with a pin and sealing member. Similarly, connections between the lower connector 10-1 and the lower external sleeve 10-2 can be either connections through the API drill pipe joint thread or connections through a common thread together with pin and sealing member.

The underground annular blowout preventer of the present invention is simple in structure, innovative in design, and high in reliability. When it is used together with an overflow and well kick pre-warning system, and the check valve is near the drill; when the signal of underground well kick and blowout is received from the ground, the drill rod is lowered to increase to a drilling pressure, so as to seal the well quickly and realize communication between the inner side of the drill pipe and the annulus, and then the pipe column is lifted to unseal the well. The present invention can effectively prevent a blowout accident and has a high feasibility. In the underground annular blowout preventer of the present invention, the torque transferred between the upper and lower drill pipe is completed by the spline pair between the upper joint and the lower joint of the annular blowout preventer, so it can sustain larger torque. Each component of the blowout preventer can sustain a reasonable amount of stress and is high in reliability. The present invention can be mounted into a well at different depth over the demarcation point of drill pipe, and it can work with the drill in realizing a sealing and unsealing for multiple times without a need to take out drill pipe to replace the blowout preventer. This helps to reduce cost of the equipment and the entire well drilling process due to the reusability. Due to the first and second check valves, the underground annular blowout preventer of the present invention can prevent the high pressure fluid in the annulus from entering the drill pipe when the annular seal loses effectiveness due to other reasons; and the underground annular blowout preventer of the present invention provides sealing at the peripheries of the first and the second flow guiding holes with a sealing member, so as to ensure that inner side of the drill pipe will not be in communication with the annulus during normal drilling process. Additionally, due to the first and second check valves, solid impurities in mud cannot damage the sealing layer and the sealing member; therefore, the service life of the sealing members is prolonged. During the well sealing process, the drill pipe can be properly lifted and lowered quickly. The drill pipe is re-lowered after the drill is lifted from the bottom of well in short time, so as to seal the annular blowout preventer and thus prevent the drill from being blocked. During the well sealing process, it is only necessary to increase the drilling pressure properly to make the spring ejector slide into the lower moving groove from the upper moving groove, and the increased drilling pressure can be controlled within the maximum drilling pressure limit that the lower drilling tool can sustain, such that the lower drilling tool of the drill pipe can be protected at much as possible during the process of sealing annulus. The assembly technique of the underground annular blowout preventer of the present invention is unique in design and innovative in technique. By using the assembly technique, the sealing effect of the blowout preventer can be guaranteed. Quick sealing and unsealing are realized due to the innovative action. A stable and reliable structure, and long service life of the blowout preventer are guaranteed.

One in the drawings and described above is skilled in the art will understand that the embodiment of the present invention as shown exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An underground annular blowout preventer, comprising an upper joint, a lower joint, a central barrel, and at least one rubber barrel, wherein said upper joint and said lower joint are sleeved outside said central barrel, wherein a lower end of said central barrel is fixedly connected with said lower joint, wherein a lower end of said upper joint is sleeved on an inner side of the upper end of said lower joint, wherein said upper joint is matched with said lower joint through a spline, wherein said rubber barrel is sleeved on an outer side of said upper joint and said rubber barrel is adapted to be extruded and expanded by said upper joint and said lower joint; a first flow guiding hole is set on said central barrel and a second flow guiding hole is set on said upper joint, a sealing member is set between an inner wall of said upper joint and an outer wall of said central barrel, a periphery of said first flow guiding hole and a periphery of said second flow guiding hole are sealed by said sealing member, and said first flow guiding hole and said second flow guiding hole are joined with each other when said upper joint moves downwards, wherein a first check valve is set inside said first flow guiding hole, and a second check valve is set inside said second flow guiding hole, wherein a spring ejector is set on an inner side of an upper end of said upper joint, wherein an outer side of said central barrel is close to said upper joint is provided with multiple moving grooves which are matched with said spring ejector, wherein an ejector on said spring ejector is in sliding cooperation with each of said moving grooves, wherein an inner wall of said central barrel is provided with an installation auxiliary hole.

2. The underground annular blowout preventer, according to claim 1, wherein said upper joint comprises of an upper joint component and an inner sleeve which are fixedly connected with each other, wherein said spring ejector is set inside said upper joint component and said second flow guiding hole is set on said upper joint component, wherein a lower end of said inner sleeve is sleeved on said inner side of said upper end of said lower joint and said inner sleeve is in clearance fit with said lower joint through said spline, wherein said rubber barrel is sleeved outside of said inner sleeve and is adapted to be extruded and expanded by said upper joint component and said lower joint.

3. The underground annular blowout preventer, according to claim 1, wherein said upper joint comprises of an upper connector, an upper external sleeve, and an inner sleeve which are fixedly connected with each other, wherein said spring ejector is set inside said upper connector, and said second flow guiding hole is set on said upper external sleeve, wherein a lower end of said inner sleeve is sleeved on said inner side of said upper end of said lower joint, and said inner sleeve is in clearance fit with said lower joint through said spline, wherein said rubber barrel is sleeved outside of said inner sleeve and is adapted to be extruded and expanded by said upper external sleeve and said lower joint.

4. The underground annular blowout preventer, according to claim 1, wherein outside of said central barrel is provided with a convex shoulder which forms a whole structure with said central barrel, wherein a thrust bearing is sleeved outside of said central barrel, and said thrust bearing is located between said convex shoulder outside of said central barrel and an upper end surface of said inner sleeve.

5. The underground annular blowout preventer, according to claim 1, wherein said central barrel comprises of a support sleeve sleeved and fixed outside of the central barrel body, wherein said thrust bearing which is between said support sleeve and said upper end surface of said inner sleeve is sleeved outside of said central barrel.

6. The underground annular blowout preventer, according to claim 1, wherein said lower joint mainly comprises of a lower connector and a lower external sleeve which are fixedly connected with each other, wherein said spline in said lower joint is inside said external sleeve which is fixedly connected with said lower end of said central barrel.

7. An assembly method of an underground annular blowout preventer, comprising the following steps:

(a) fixing an inner sleeve, embedding multiple spacer rings and a rubber barrel outside of the inner sleeve along a thread direction at an upper end of said inner sleeve, such that said spacer rings and said rubber barrel are limited at an upper right side of a convex shoulder at a middle of said inner sleeve;

(b) embedding a thrust bearing inside an upper external sleeve from a lower end thereof, and fixedly connecting a lower end of said upper external sleeve and said upper end of said inner sleeve;

(c) embedding a first check valve and a second check valve separately on side walls of a central barrel and said upper external sleeve and tightening to a predetermined torque, embedding a sealing member to a relevant position of said central barrel and mounting said central barrel to said upper external sleeve and said inner sleeve;

(d) embedding a lower joint to outside of said central barrel and said inner sleeve, stretching an outward expanding tool to an inner side of said central barrel and blocking the tool in an installation auxiliary hole, and fixing said lower joint while rotating said central barrel, or fixing said central barrel while rotating said lower joint so as to tighten a thread pair between a lower end of said central barrel and said lower joint to a predetermined torque; and (e) embedding a spring ejector inside an upper connector, inserting said upper connector into said central barrel along an outer wall thereof, fixing said upper external sleeve while rotating said upper connector, or fixing said upper connector while rotating said upper external sleeve so as to tighten a thread pair between said upper connector and said upper external sleeve to a predetermined torque, such that an ejector on said spring ejector slides into an upper moving groove of said central barrel during a downward movement process of said upper connector.

8. An assembly method of an underground annular blowout preventer, comprising the following steps:

(a) fixing an inner sleeve, embedding multiple spacer rings and a rubber barrel outside of said inner sleeve along a thread direction on an upper end of said inner sleeve, such that said spacer rings and said rubber barrel are limited above a convex shoulder at a middle of said inner sleeve;

(b) mounting a first check valve on a support sleeve and embedding a spring ejector to an inner wall of an upper joint component, embedding a support sleeve inside said upper joint component from a lower end thereof and embedding a thrust bearing inside said upper joint component from said lower end thereof, and fixedly connecting said lower end of said upper joint component and said upper end of said inner sleeve;

(c) embedding a central barrel body into said inner sleeve from the lower end thereof and passing through said support sleeve, fixedly connecting said central barrel body and said support sleeve and embedding a second check valve to said inner wall of said upper joint component; and (d) embedding a lower joint into said central barrel body along a lower end of said central barrel body and an external spline end of said internal sleeve, stretching an outward expanding tool to an inner side of said central barrel body and blocking the tool into an installation auxiliary hole, fixing said lower joint while rotating said central barrel body, or fixing said central barrel body while rotating said lower joint, so as to tighten a thread pair between said central barrel body and said lower joint to a predetermined torque, such that an ejector on said spring ejector slides into an upper moving groove of said central barrel body during a downward movement process of said upper joint component.

* * * * *